US006541091B2

(12) United States Patent
Washburn et al.

(10) Patent No.: US 6,541,091 B2
(45) Date of Patent: Apr. 1, 2003

(54) SECURE STICKER AND INTEGRATED LABEL/FORM

(75) Inventors: David E. Washburn, Kettering, OH (US); Rajendra Mehta, Centerville, OH (US); Khristopher J. Fitzgerald, Latham, NY (US)

(73) Assignee: The Standard Register Company, Dayton, OH (US)

( * ) Notice: Subject to any disclaimer, the term of this patent is extended or adjusted under 35 U.S.C. 154(b) by 77 days.

(21) Appl. No.: 09/916,862

(22) Filed: Jul. 27, 2001

(65) Prior Publication Data

US 2001/0046577 A1 Nov. 29, 2001

Related U.S. Application Data

(62) Division of application No. 09/225,025, filed on Jan. 4, 1999, now Pat. No. 6,303,202.

(51) Int. Cl.[7] ..... G09F 3/10

(52) U.S. Cl. ..... 428/40.1; 40/626; 40/638; 283/72; 283/81; 283/94; 283/101; 283/107; 283/108; 283/109; 428/41.7; 428/41.8; 428/42.1; 428/42.2; 428/43; 428/131; 428/137; 428/138; 428/201; 428/202; 428/203; 428/204; 428/915; 428/916; 428/917

(58) Field of Search ..... 428/40.1, 41.7, 428/41.8, 42.1, 42.2, 42.3, 43, 131, 137, 138, 201, 202, 203, 204, 915, 916, 917; 40/626, 638; 283/72, 81, 94, 101, 107, 108, 109

(56) References Cited

U.S. PATENT DOCUMENTS 4,121,003 A 10/1978 Williams
4,379,573 A 4/1983 Lomeli et al.
4,454,179 A 6/1984 Bennett et al.
5,007,191 A 4/1991 Klein
5,020,830 A 6/1991 Shishido
5,098,759 A 3/1992 Felix
5,174,609 A 12/1992 Tucker
5,240,789 A 8/1993 Breen et al.
5,275,855 A 1/1994 Kobayashi et al.
5,294,470 A 3/1994 Ewan
5,324,153 A 6/1994 Chess
5,358,281 A 10/1994 Greig
5,376,418 A 12/1994 Rogers et al.
5,597,635 A 1/1997 Pusl et al.
5,618,600 A 4/1997 Denklau
5,629,093 A 5/1997 Bischof et al.
5,683,774 A 11/1997 Faykish et al.

*Primary Examiner*—Nasser Ahmad
(74) *Attorney, Agent, or Firm*—Killworth, Gottman, Hagan & Schaeff LLP

(57) ABSTRACT

A secure sticker is provided comprising a waterproof base portion including a paper ply, static printed matter, and a resin, wherein the paper ply and the static printed matter are sealed within the resin, and wherein the resin is substantially transparent to light in the visible spectrum. In accordance with one embodiment of the present invention, a secure sticker is provided comprising a substantially waterproof base portion, a liner ply, and an adhesive interface. The substantially waterproof base portion includes a paper ply, static printed matter, and a resin. The paper ply and the static printed matter are sealed within the resin. The resin is substantially transparent to light in the visible spectrum. The liner ply defines a label portion and a removable portion, wherein the label portion includes variable printed matter thereon. The adhesive interface is arranged to adhere the liner ply to the base portion. The adhesive interface is substantially transparent to light in the visible spectrum and the adhesive interface and the liner ply are arranged such that the label portion is more likely than the removable portion to remain adhered to the base portion.

15 Claims, 5 Drawing Sheets

SECURE STICKER AND INTEGRATED LABEL/FORM

CROSS-REFERENCE TO RELATED APPLICATIONS

This Application is a division of U.S. Patent Application Ser. No. 09/225,025, filed Jan. 4, 1999 now U.S. Pat. No. 6,303,202.

BACKGROUND OF THE INVENTION

The present invention relates to secure stickers or labels for windshields and other transparent and non-transparent surfaces. More particularly, the present invention relates to a secure sticker comprising a waterproof base portion including a paper ply, static printed matter, and a resin, wherein the paper ply and the static printed matter are sealed within the resin, and wherein the resin is substantially transparent to light in the visible spectrum.

Many conventional secure stickers or labels are easily altered because the security features embodied therein are simply insufficient impediments to the sophisticated counterfeiter. Further, many conventional secure stickers are not resistant to ordinary wear and tear and tend to deteriorate over time. The deteriorated appearance of these conventional secure stickers does not provide a reliable indication of authenticity. Other stickers are not resistant to water or water-based solvents and, as such, are subject to inadvertent destruction or deterioration. Still other security stickers are not easily readable when secured to transparent mediums. Accordingly, there is a need for a secure sticker or label that incorporates improved security features and that is resistant to alteration, cut-and-paste attempts, and removal and reuse. Further, there is a need for a secure sticker that is waterproof, resistant to ordinary wear and tear.

BRIEF SUMMARY OF THE INVENTION

This need is met by the present invention wherein a secure sticker is provided comprising a waterproof base portion including a paper ply, static printed matter, and a resin, wherein the paper ply is sealed within the resin, and wherein the resin is substantially transparent to light in the visible spectrum.

In accordance with one embodiment of the present invention, a secure sticker is provided comprising a substantially waterproof base portion, a liner ply, and an adhesive interface arranged to adhere the liner ply to the base portion. The base portion includes a paper ply, static printed matter, and a resin. The paper ply is sealed within the resin and the resin is substantially transparent to light in the visible spectrum. The liner ply defines at least one label portion and a removable portion therein and the label portion includes variable printed matter thereon. The adhesive interface is also substantially transparent to light in the visible spectrum. The adhesive interface and the liner ply are arranged such that the removable portion is separable from the base portion independent of the label portion.

The static printed matter may be sealed within the resin and may comprise a graphical image, security printing, an element selected from the group consisting of laid lines, a fluorescent ink, micro-printing, and relatively high resolution graphics, and combinations thereof. The variable printed matter may comprise identification indicia, numerical data, an electronically readable encoded symbol, e.g., a bar code, and combinations thereof.

Preferably, the adhesive interface and the liner ply are arranged such that the at least one label portion is more likely than the removable portion to remain adhered to the base portion. The label portion and the removable portion may be defined by die cuts in the liner ply. The die cuts may comprise patterned edge die cuts.

The resin may comprise a transparentizing agent. The paper ply may be sealed within the resin such that the paper ply exhibits an increase in degree of transparency.

The liner ply may include a patterned release layer positioned adjacent the adhesive interface. The patterned release layer may define release layer voids positioned in registration with the label portion.

In accordance with another embodiment of the present invention, a secure sticker is provided comprising a substantially waterproof base portion, variable printed matter produced on a first surface of the base portion, a liner ply, and an adhesive interface. The base portion includes a paper ply, static printed matter, and a resin. The paper ply is sealed within the resin. The resin is substantially transparent to light in the visible spectrum. The liner ply includes at least one cut-out portion formed therein. The cut-out portion is positioned in registration with the variable printed matter. The adhesive interface is arranged to adhere the liner ply to the first surface of the base portion, is substantially transparent to light in the visible spectrum, and includes at least one adhesive void formed therein. The adhesive void is positioned in registration with the cut-out portion and the variable printed matter.

The resin may comprise a transparentizing agent and the paper ply may be sealed within the resin such that the paper ply exhibits an increase in degree of transparency. The paper ply may further bear an opaque portion resistant to the transparentizing agent and the variable printed matter may be printed so as to lie in registration with the opaque portion.

The static printed matter may comprise a graphical image, security printing, an element selected from the group consisting of laid lines, a fluorescent ink, a micro-printed image, and a relatively high resolution graphical image, and combinations thereof. The variable printed matter may comprise an electronically readable encoded symbol, e.g., a bar code. Additionally, the variable printed matter may comprise identification indicia or numerical data.

In accordance with yet another embodiment of the present invention, a secure sticker is provided comprising a substantially waterproof base portion, variable printed matter produced on a first surface of the base portion, and an inactivated adhesive interface on the surface of the base portion. The substantially waterproof base portion includes a paper ply, static printed matter, and a resin. The paper ply is sealed within the resin and the resin is substantially transparent to light in the visible spectrum. The adhesive interface is substantially tack-free prior to activation, is substantially transparent to light in the visible spectrum, and includes at least one adhesive void formed therein. The adhesive void is positioned in registration with the variable printed matter.

In accordance with yet another embodiment of the present invention, an integrated label/form is provided comprising at least one secure sticker formed within a sheet of form stock. The secure sticker is constructed according to embody the characteristics of the various secure stickers according to the present invention. The sheet of form stock may include an additional transparentized portion defined in a portion of the form stock offset from the secure sticker.

Accordingly, it is an object of the present invention to provide an improved secure sticker and an integrated label/form embodying a plurality of enhanced security, durability, and readability features. Other objects of the present invention will be apparent in light of the description of the invention embodied herein.

BRIEF DESCRIPTION OF THE SEVERAL VIEWS OF THE DRAWINGS

The following detailed description of the preferred embodiments of the present invention can be best understood when read in conjunction with the following drawings, where like structure is indicated with like reference numerals and in which.

DETAILED DESCRIPTION OF THE PREFERRED EMBODIMENTS

Figure 2:
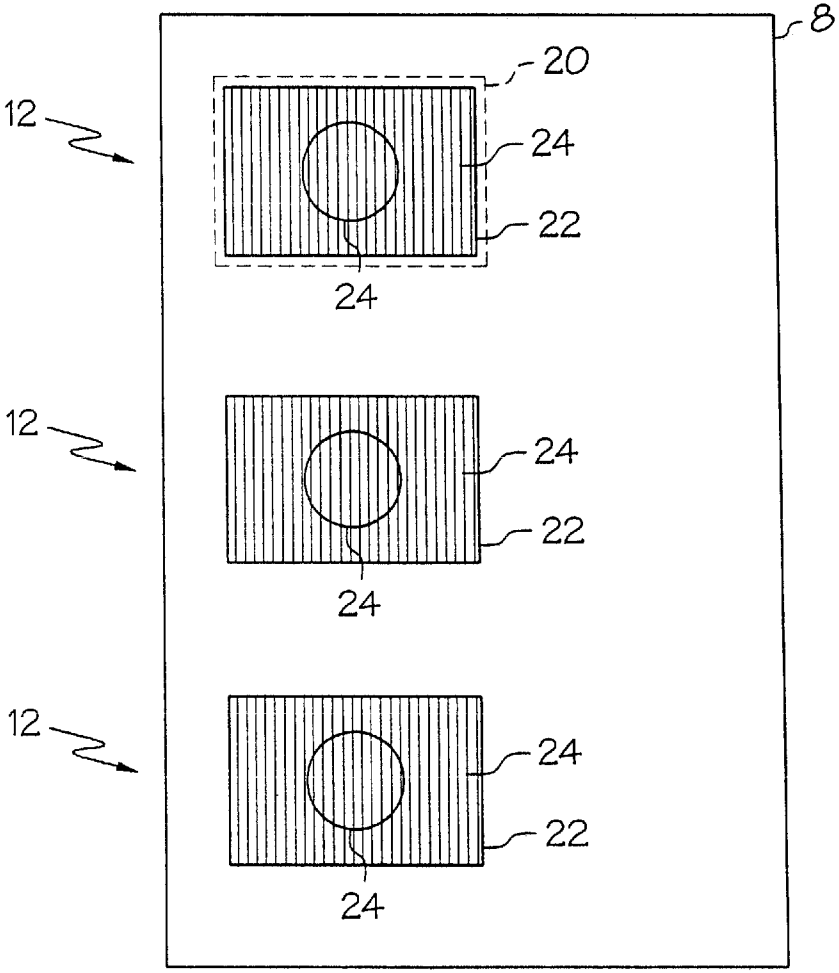
FIG. 2 is an illustration of a back side of a secure label according to the present invention.
Figure 4:
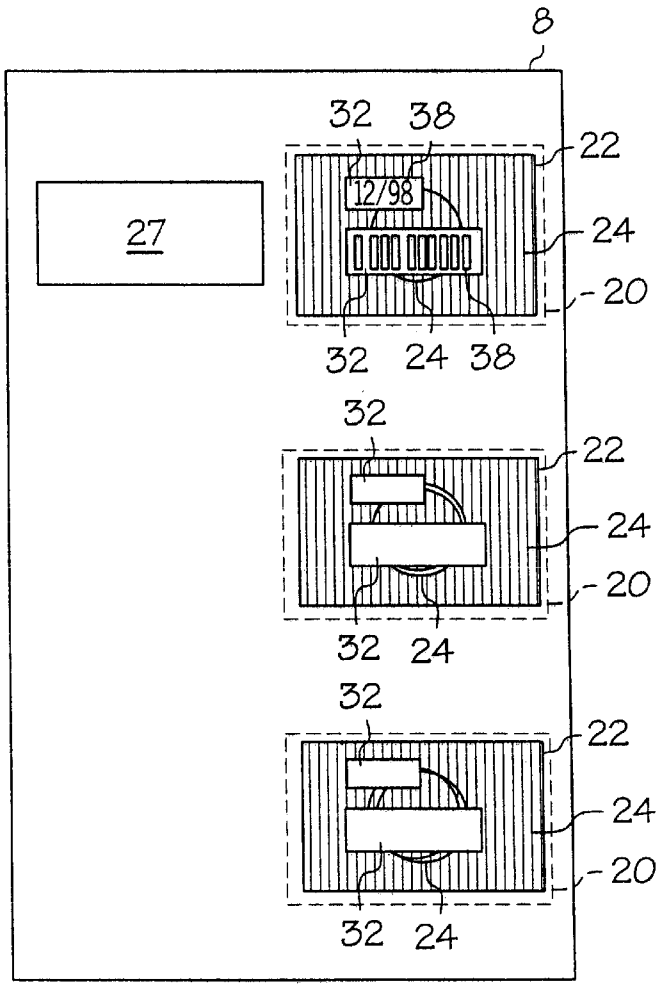
FIG. 4 is an illustration of a front side of a secure label having portions of its liner ply removed.
Figure 3:
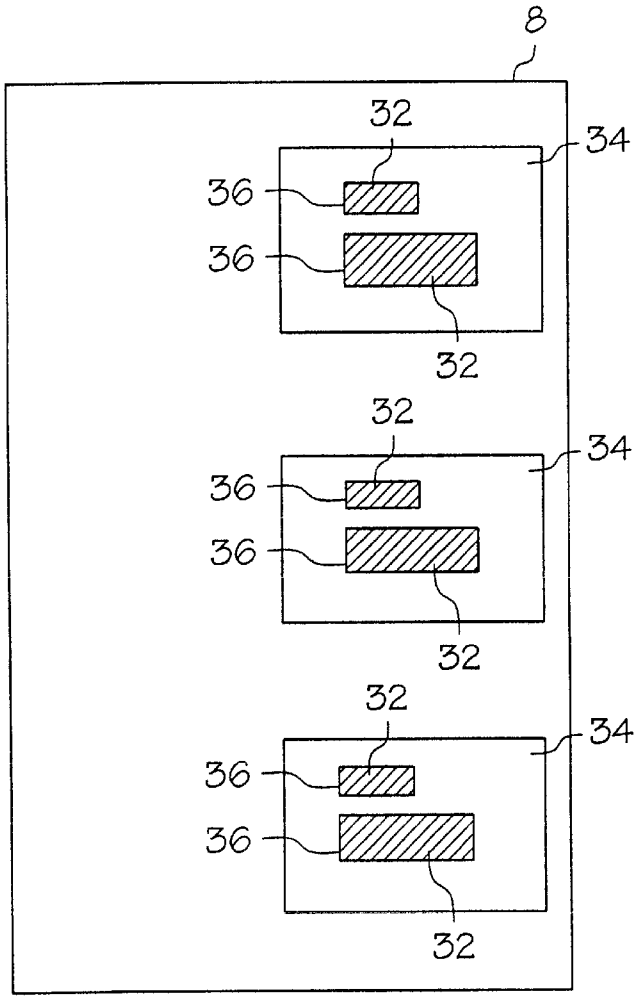
FIG. 3 is an illustration of a front side of a secure label according to the present invention.
Figure 5:
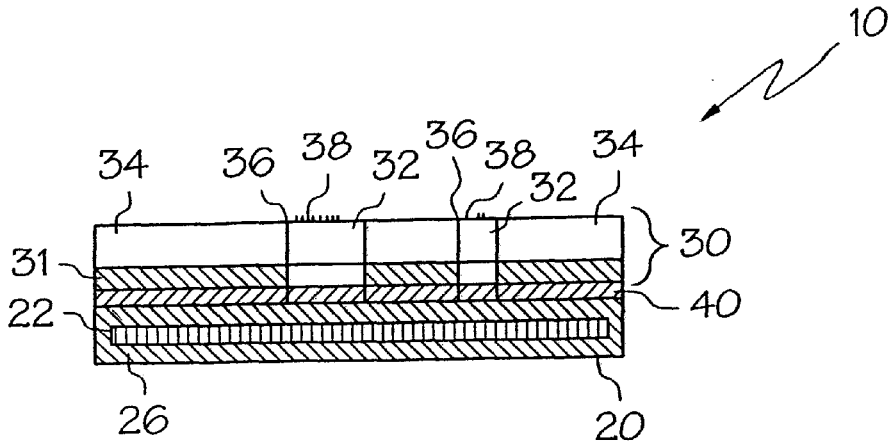
FIG. 5 is a cross-sectional illustration of a secure label of the present invention.
Figure 6:
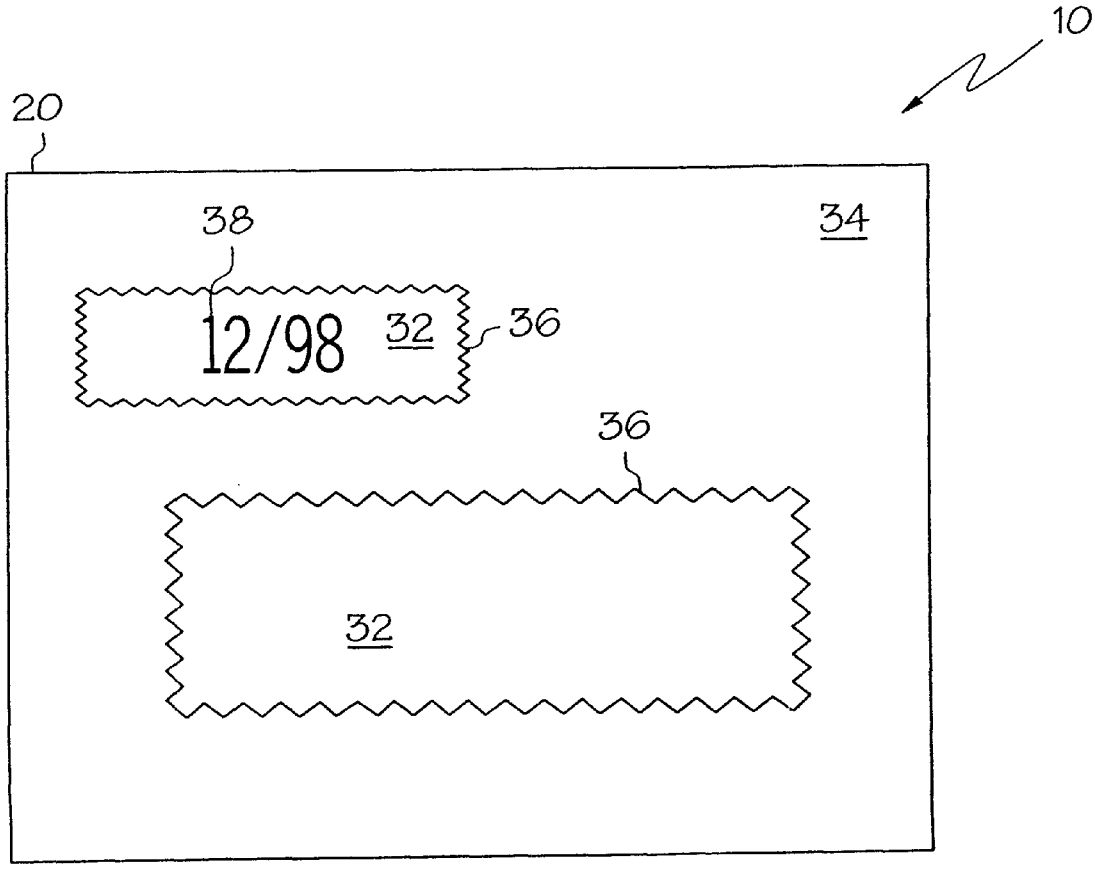
FIG. 6 is a plan view of the secure label illustrated in FIG. 5.

Referring initially to FIGS. 1–7 a secure sticker or label 10 according to a first embodiment of the present invention is illustrated. Initially, it is noted that FIGS. 2–4 illustrate the secure sticker 10 of the present invention as part of an integrated label/form including a sheet of form stock 8 and a plurality of distinct sticker portions 12 formed in the form stock 8. U.S. Pat. No. 4,379,573, the disclosure of which is incorporated herein by reference, illustrates specific structural details of an integrated label/form.

Figure 1:
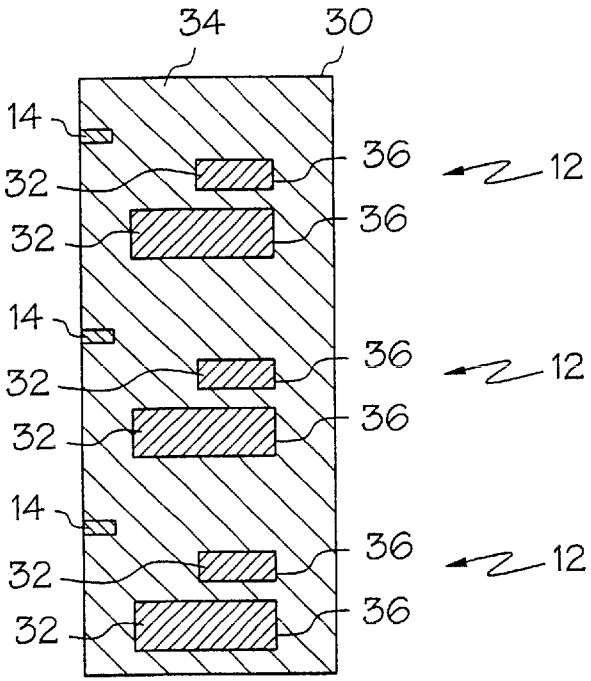
FIG. 1 is an illustration of a patterned release liner utilized in one embodiment of the present invention.
Figure 7:
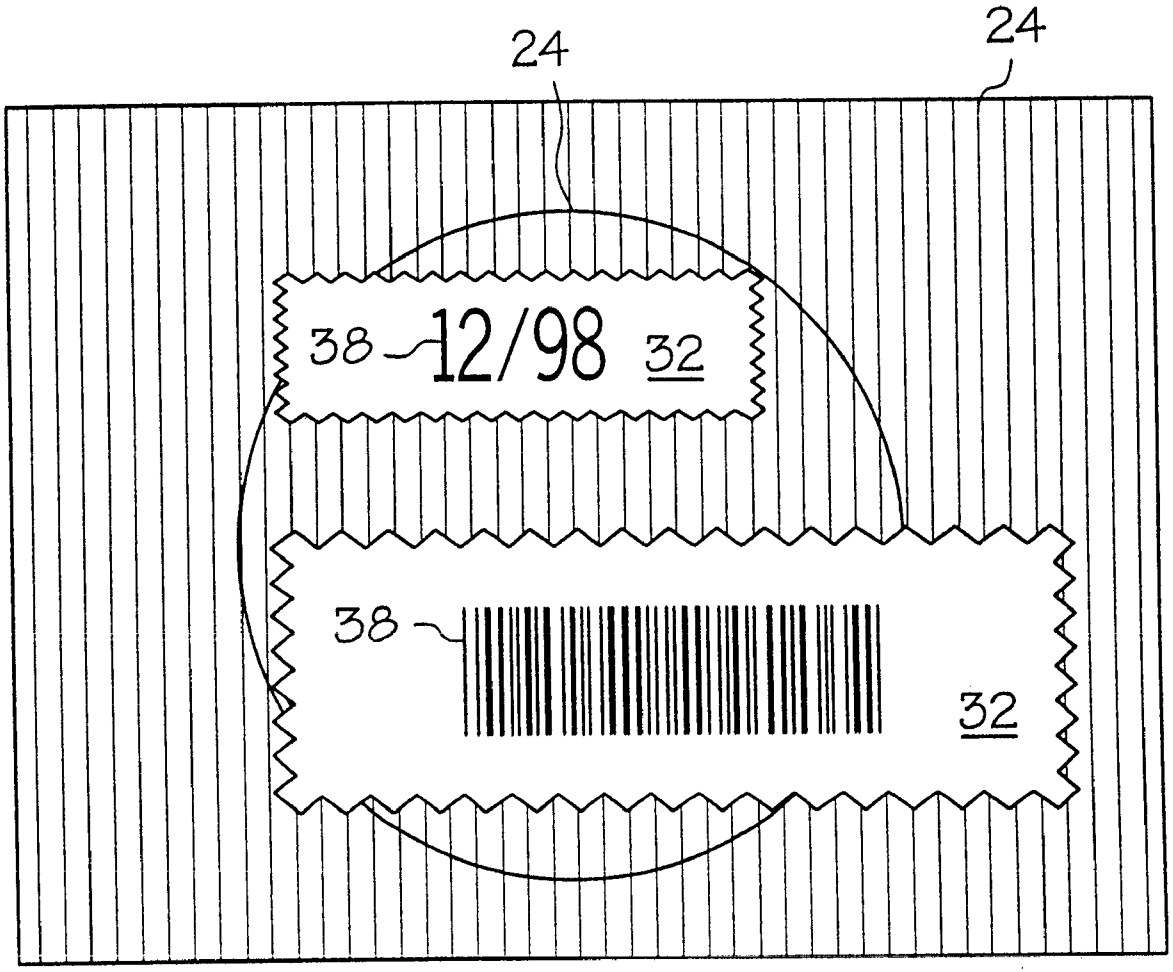
FIG. 7 is an illustration of the secure label of FIG. 6 having portions of its liner ply removed.

Each secure sticker 10 comprises a substantially waterproof base portion 20, a liner ply 30, and an adhesive interface 40. The substantially waterproof base portion 20 includes a paper ply 22, static printed matter 24, and a resin 26. The paper ply 22 and the static printed matter 24 are sealed within the resin 26. The resin 26 is substantially transparent to light in the visible spectrum. In this manner, the static printed matter 24 is visible through the resin, as is illustrated in FIGS. 2, 4, and 7. FIG. 1 illustrates a patterned release liner utilized in one embodiment of the present invention and a sequence of sensor marks 14 for providing an indication of the position of respective sticker portions.

According to one aspect of the present invention, the resin 26 is impregnated into the paper ply 22 to render the paper ply translucent or transparent. In addition, it is contemplated by the present invention that the integrated form/label may include one or more additional transparentized portions 27. Typically, the additional transparentized portion 27 may function as mailing address window in the event the integrated form/label is arranged as a C, V, or Z-fold mailer.

It is contemplated that the static printed matter 24, or portions thereof, need not be sealed within the resin 26. For example, the static printed matter 24 could be (i) sandwiched between the resin 26 and the adhesive interface 40 or (ii) printed on the back side of the base portion 20 with a preferably waterproof ink such as a UV curable ink.

In one embodiment of the present invention, the resin 26 comprises a transparentizing agent arranged to render the paper ply 22 substantially transparent to light in the visible spectrum. In this manner, the entire base portion 20 can be made substantially transparent to light in the visible spectrum. The resin 26 may comprise a UV curable resin, an electron beam (EB) curable resin, a heat curable resin, or another suitable resinous material that will render the paper ply portion waterproof.

The liner ply 30, which is illustrated in detail in FIG. 1, defines respective label portions 32 and a removable portion 34 defined by die cuts 36 in the liner ply 30. The respective label portions 32 include variable printed matter 38 thereon. In one embodiment of the present invention, the die cuts 36 comprise patterned edge die cuts to enhance the security features of the sticker 10 by making it more difficult to remove the label portions 32 in one piece without tearing and by making it more difficult to reproduce or duplicate the label portions 32 (see FIGS. 6 and 7).

The adhesive interface 40 is arranged to adhere the liner ply 30 to the base portion 20 and is substantially transparent to light in the visible spectrum. In this manner, the adhesive interface 40 will not interfere with the visibility of the static printed matter 24. The adhesive interface 40 and the liner ply 30 are arranged such that the label portions 32 are more likely than the removable portion 34 to remain adhered to the base portion 20. Specifically, the liner ply 30 includes a patterned release layer 31 positioned adjacent the adhesive interface 40. The release layer 31 is patterned such that the release material is interposed exclusively between the removable portion 34 and the adhesive interface 40 and such that the release layer 31 defines release layer voids 33 positioned in registration with the label portion 32 (see FIG. 5). The adhesive typically comprises a UV or EB curable hot melt adhesive, a conventional PSA, or a moisture activated adhesive. Preferably, the adhesive is UV light resistant, may be applied from about −10° F. to about 120° F., and may be used from about −40° F. to about 165° F. The liner ply 30 is preferably a pattern silicone patch but may be a continuous strip.

In specific embodiments of the present invention, the static printed matter 24 comprises a graphical image, e.g., a company logo or security image. In addition, the static printed matter 24 may comprise other anti-tampering components, including laid lines, fluorescent ink, microprinting, high resolution graphics, etc. The static printed matter 24 can be applied via any conventional method including lithography, flexography, letterpress, gravure, intaglio, or dry offset.

In other embodiments of the present invention, the variable printed matter 38 comprises an electronically readable encoded symbol such as a bar code (see FIGS. 4 and 7). In addition, the variable printed matter 38 may comprise identification indicia or numerical data. The variable printed matter is added to the sticker 10 preferably by laser printing. It may also be imaged via thermal transfer, ink jet, ion deposition, other non-impact printing, or another means capable of creating a high contrast image.

Figure 8:
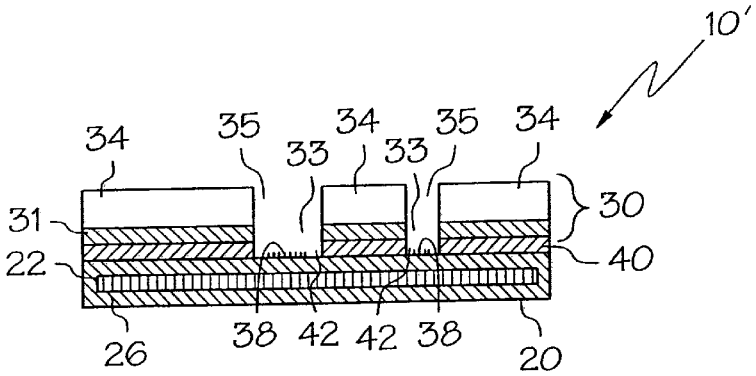
FIG. 8 is a cross-sectional illustration of a secure label according to an alternative embodiment of the present invention.
Figure 9:
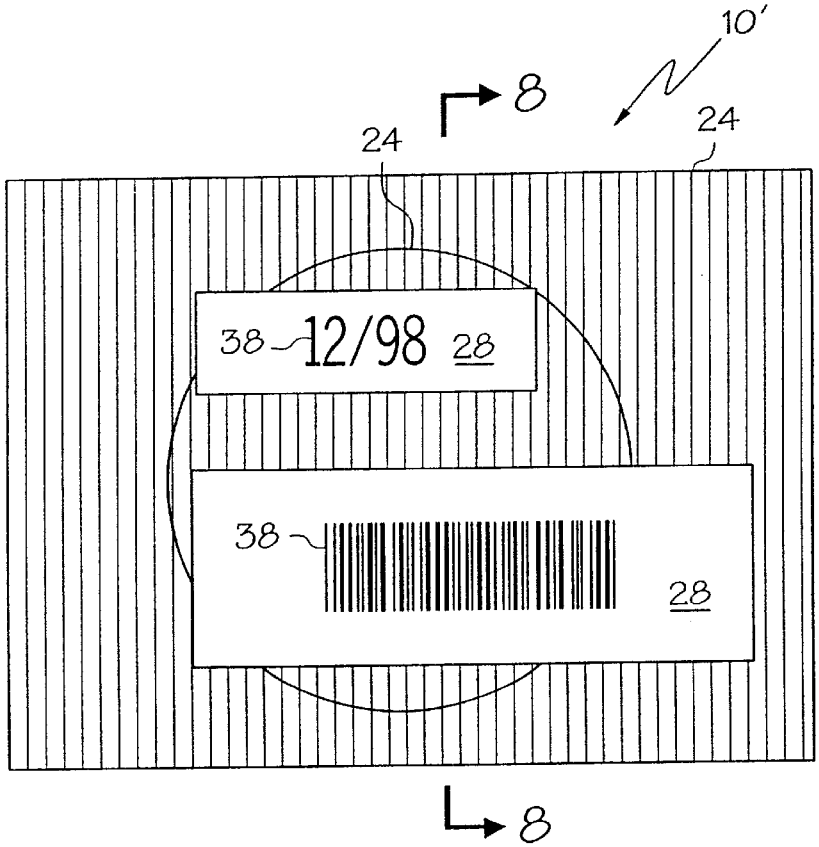
FIG. 9 is a plan view of the secure label illustrated in FIG. 8.

An alternative embodiment of the present invention is illustrated in FIGS. 8 and 9. The secure sticker 10' of the embodiment of FIGS. 8 and 9 includes variable printed matter produced directly on a surface of the base portion 20. To facilitate such an arrangement, the liner ply 30 includes one or more cut-out portions 35 and a patterned release layer 31. The cut-out portions may be provided through an air ejection process. Further, the adhesive interface 40 includes adhesive voids 42 formed therein and the release layer 31 includes release layer voids 33 formed therein. The cut-out portion 35 is positioned in registration with the variable printed matter 38 and the adhesive voids 42 and the release layer voids 33 are positioned in registration with the cut-out portion 35 and the variable printed matter 38.

In the embodiment of FIGS. 8 and 9, the paper ply 22 further bears an opaque portion 28, e.g., white opaque ink, and the variable printed matter 38 is printed so as to lie in registration with the opaque portion 28. The opaque portion 28 is particularly desirable where the resin 26 comprises a transparentizing agent arranged to render the paper ply 22 substantially transparent to light in the visible spectrum. The opaque portion 28 provides a contrasting background to the variable printed matter 38 and is preferably resistant to the transparentizing agent of the resin 26.

Figure 10:
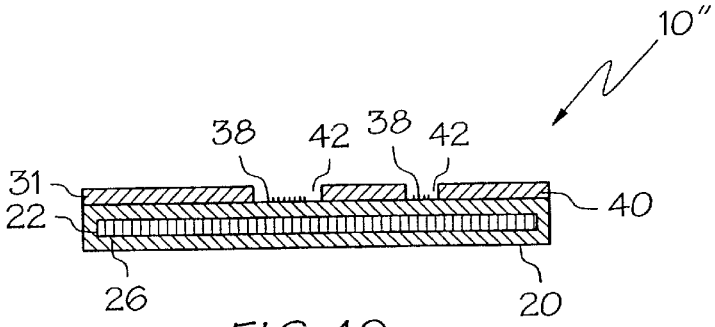
FIG. 10 is a cross-sectional illustration of a secure label according to another embodiment of the present invention.

Referring now to the secure sticker 10" illustrated in FIG. 10, it is noted that the liner ply 30 illustrated in the embodiment of FIGS. 8 and 9 may be omitted from the structure of the secure sticker 10" if the adhesive interface 40 provided is substantially tack-free prior to activation. For example, the adhesive interface 40 may comprise a remoist adhesive activated by moisture, a thermally activated adhesive or any other adhesive that is substantially tack-free prior to activation.

Having described the invention in detail and by reference to preferred embodiments thereof, it will be apparent that modifications and variations are possible without departing from the scope of the invention defined in the appended claims. For example, it is contemplated that the embodiments of the present invention may be cut sheet or continuous forms, single ply or multi-ply.

What is claimed is:

1. A secure sticker comprising:

a substantially waterproof base portion including a paper ply, static printed matter, and a resin, wherein said resin is impregnated into said paper ply, and said resin is substantially transparent to light in the visible spectrum;

variable printed matter produced on a first surface of said base portion;

a liner ply including at least one cut-out portion formed therein, wherein said cut-out portion is positioned in registration with said variable printed matter; and an adhesive interface arranged to adhere said liner ply to said first surface of said base portion, wherein said adhesive interface is substantially transparent to light in the visible spectrum, wherein said adhesive interface includes at least one adhesive void formed therein, and wherein said adhesive void is positioned in registration with said cut-out portion and said variable printed matter.

2. A secure sticker as claimed in claim 1 wherein said resin comprises a transparentizing agent.

3. A secure sticker as claimed in claim 2 wherein said paper ply is impregnated with said resin such that said paper ply exhibits an increase in degree of transparency, wherein said paper ply further bears an opaque portion resistant to said transparentizing agent, and wherein said variable printed matter is printed so as to lie in registration with said opaque portion.

4. A secure sticker as claimed in claim 1 wherein said static printed matter comprises a graphical image.

5. A secure sticker as claimed in claim 1 wherein said static printed matter comprises security printing.

6. A secure sticker as claimed in claim 5 wherein said static printed matter comprises an element selected from the group consisting of laid lines, a fluorescent ink, a micro-printed image, and a relatively high resolution graphical image.

7. A secure sticker as claimed in claim 1 wherein said variable printed matter comprises an electronically readable encoded symbol.

8. A secure sticker as claimed in claim 7 wherein said encoded variable printed matter comprises a bar code.

9. A secure sticker as claimed in claim 1 wherein said variable printed matter comprises identification indicia.

10. A secure sticker as claimed in claim 1 wherein said variable printed matter comprises numerical data.

11. A secure sticker comprising:

a substantially waterproof base portion including a paper ply, static printed matter, and a resin, wherein said resin is impregnated into said paper ply, and said resin is substantially transparent to light in the visible spectrum;

variable printed matter produced on a first surface of said base portion;

an inactivated adhesive interface on said first surface of said base portion, wherein said adhesive interface is substantially tack-free prior to activation, said adhesive interface is substantially transparent to light in the visible spectrum, said adhesive interface includes at least one adhesive void formed therein, and said adhesive void is positioned in registration with said variable printed matter.

12. An integrated label/form comprising at least one secure sticker formed within a sheet of form stock, wherein said at least one secure sticker comprises:

a substantially waterproof base portion including a paper ply, static printed matter, and a resin, wherein said resin is impregnated into said paper ply, and said resin is substantially transparent to light in the visible spectrum;

variable printed matter produced on a first surface of said base portion;

a liner ply including at least one cut-out portion formed therein, wherein said cut-out portion is positioned in registration with said variable printed matter; and an adhesive interface arranged to adhere said liner ply to said first surface of said base portion, wherein said adhesive interface is substantially transparent to light in the visible spectrum, wherein said adhesive interface includes at least one adhesive void formed therein, and wherein said adhesive void is positioned in registration with said cut-out portion and said variable printed matter.

13. An integrated label/form as claimed in claim 12 wherein said paper ply is sealed within said resin such that said paper ply exhibits an increase in degree of transparency.

14. An integrated label/form as claimed in claim 13 wherein said sheet of form stock includes an additional transparentized portion defined in a portion of said form stock offset from said secure sticker.

15. An integrated label/form comprising at least one secure sticker formed within a sheet of form stock, wherein said at least one secure sticker comprises:

a substantially waterproof base portion including a paper ply, static printed matter, and a resin, wherein said resin is impregnated into said paper ply, and said resin is substantially transparent to light in the visible spectrum;

variable printed matter produced on a first surface of said base portion;

an inactivated adhesive interface on said first surface of said base portion, wherein said adhesive interface is substantially tack-free prior to activation, said adhesive interface is substantially transparent to light in the visible spectrum, said adhesive interface includes at least one adhesive void formed therein, and said adhesive void is positioned in registration with said variable printed matter.

* * * * *